United States Patent [19]

DeLong et al.

[11] Patent Number: 5,033,526

[45] Date of Patent: Jul. 23, 1991

[54] OFFICE SPACE DIVIDING SYSTEM

[75] Inventors: Ronald B. DeLong, Belmont; John P. Conner, Grandville, both of Mich.

[73] Assignee: Westinghouse Electric Corp., Pittsburgh, Pa.

[21] Appl. No.: 523,773

[22] Filed: May 15, 1990

[51] Int. Cl.[5] ..... E04B 1/343

[52] U.S. Cl. ..... 160/135; 160/351; 52/239

[58] Field of Search ..... 160/135, 351; 52/36, 52/239, 584, 126.3, 64, 726, 127

[56] References Cited

U.S. PATENT DOCUMENTS

| | | | |
|---|---|---|---|
| 4,102,089 | 7/1978 | Paisley | 52/36 |
| 4,129,163 | 12/1978 | Johnson | 52/239 |
| 4,192,106 | 3/1980 | Hell | 52/36 |
| 4,719,731 | 1/1988 | Ravotti et al. | 52/239 |
| 4,907,388 | 3/1990 | Siahatgar | 52/584 |

*Primary Examiner*—Blair M. Johnson

*Assistant Examiner*—Korie Chan

*Attorney, Agent, or Firm*—D. R. Lackey

[57] ABSTRACT

A space dividing system which includes vertically disposed posts and space dividing panels. Each post includes a center core and a plurality of circumferentially spaced, longitudinally extending T-shaped members having a stem or leg portion integrally joined to the core, and a flange spaced outwardly from the core. The space between the core and inner surfaces of the flanges defines vertical wire ways. Each space dividing panel has upper and lower hook-like connector assemblies fixed to its vertical edges. The T-shaped members have predetermined portions of their associated flanges removed to define access openings having flange-defined support edges for supporting the upper and lower hook-like connector assemblies. Flanges of T-shaped members not associated with a space dividing panel are concealed by one or more post covers having retaining beds which removably engage lateral edges of predetermined flanges.

20 Claims, 6 Drawing Sheets

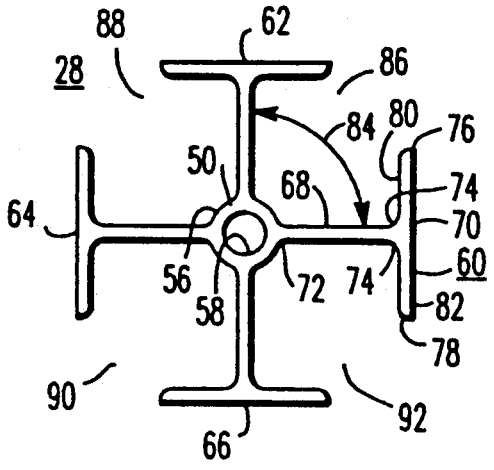
FIG. 2
FIG. 3
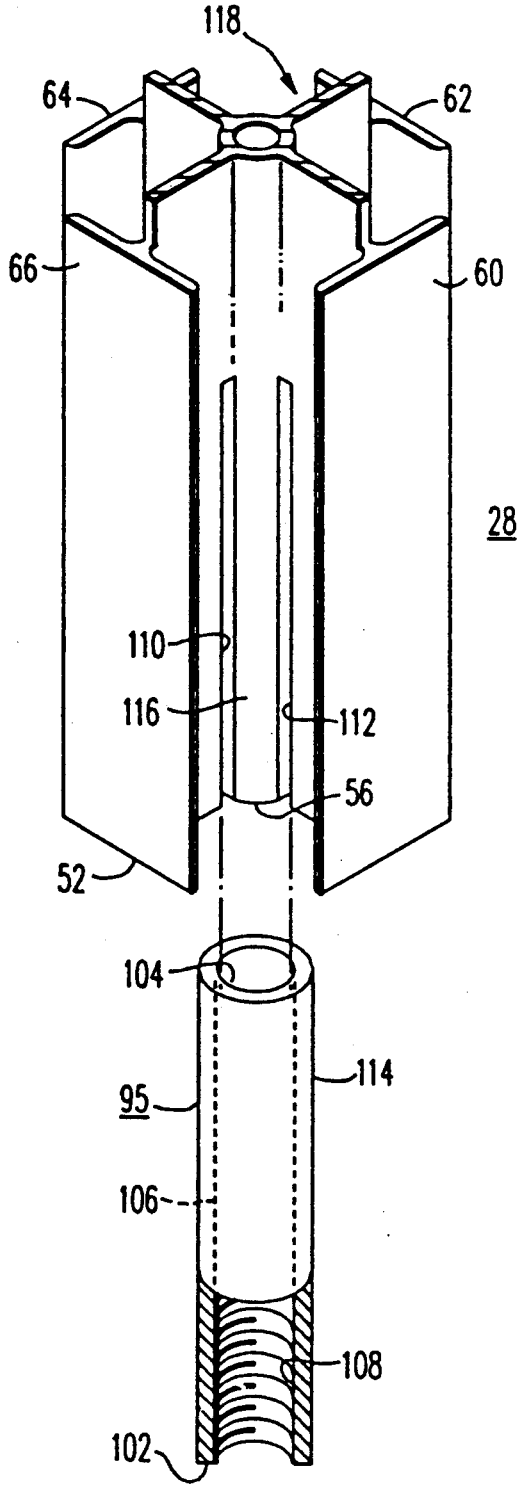

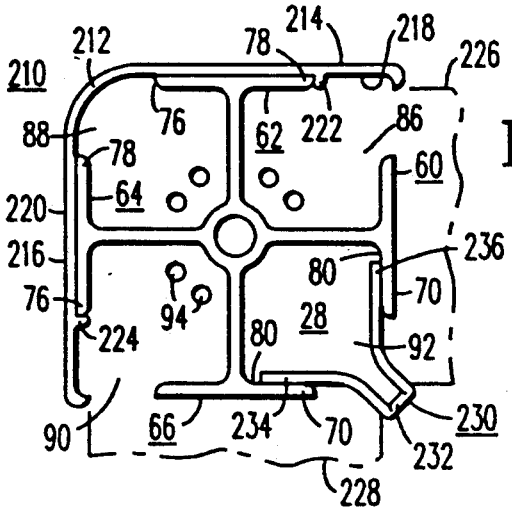
FIG. 15
FIG. 16
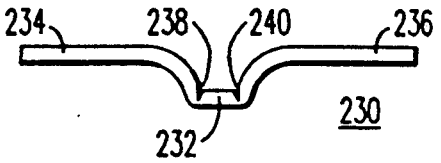
FIG. 16A
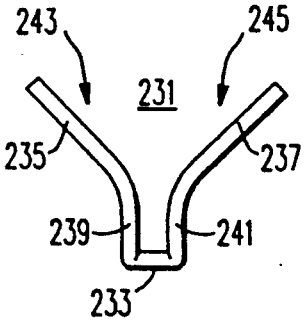
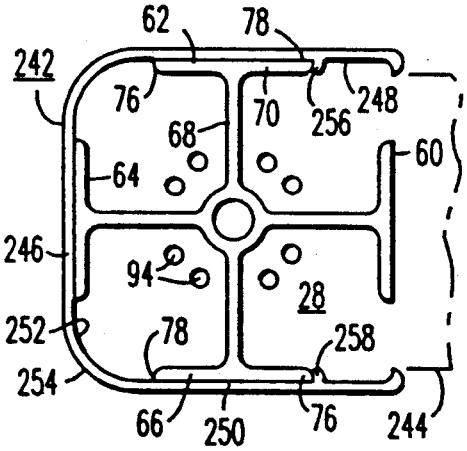
FIG. 17
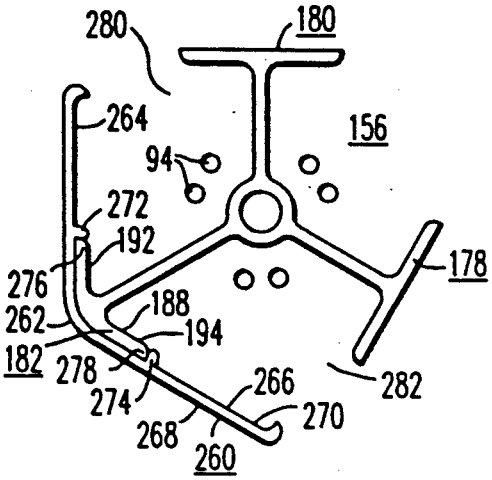
FIG. 18

OFFICE SPACE DIVIDING SYSTEM

TECHNICAL FIELD

The invention relates in general to open plan office space dividing partition systems, and more specifically to such systems which are post-based, including a support post at the juncture of space dividing panels, and at the end of a panel which is not joined to another panel.

BACKGROUND ART

Certain types of open plan office space dividing systems utilize posts to support space dividing panels, while other types connect the vertical edges of the panels directly together. Pole-based systems have the advantage of providing "center line modularity", fixing the dimension for a string of panels regardless of how many branches are created at each post or pole. Non-post based systems increase the dimension of a string of panels by the panel thickness at each branch, called "creep", which can complicate laying out the system, including selection of work surface widths and other accessories which are supported from the panels.

U.S. Pat. No. 3,762,116, which is assigned to the same assignee as the present application, discloses a post-based space dividing system of the prior art. A hollow tubular post has panel connector adapters secured to each end which define vertically oriented annular slots adapted to receive complementary shaped hook connectors fixed to vertical edges of the space dividing panels. When different height panels are to be joined to a common post, it presents a panel-to-post attachment problem. U.S. Pat. No. 3,809,142, which is also assigned to the same assignee as the present application, illustrates the number of additional parts and special post construction resulting from an innovative solution to this problem.

It would be desirable, and it is an object of the present invention, to provide a new and improved post-based space dividing system which preserves the advantage of centerline modularity, while utilizing the same post construction for connecting equal height panels and/or unequal height panels, as desired, with no extra or special parts being required.

It would also be desirable and is another object of the invention to be able to utilize the post for vertical wire ways, which is not possible in the post-based systems of the hereinbefore mentioned U.S. patents.

SUMMARY OF THE INVENTION

Briefly, the present invention is a post-based office space dividing system which includes an extruded metallic post having a plurality of sides, as opposed to a round post, with at least certain of the sides being flat. The post includes a central core and a plurality of circumferentially spaced, longitudinally extending T-shaped members. Each T-shaped member has a stem or leg portion and a flange portion having vertically oriented lateral edges. The leg portion has one end integrally attached to the core and the other end integrally attached to the flange at a point intermediate the lateral edges of the flange. The flanges are thus spaced outwardly from the central core by the leg portions, defining a space between the core and inner surfaces of the flanges for vertical wire ways which may connect certain types of wiring, such as communication wiring, between horizontal raceways at the base, waist, and/or top of the panels. Access to the wire ways is provided by dimensioning the flanges between their lateral edges such that an ample space is provided between any two adjacent flanges for laying in wires. Thus, while the basic outer configuration of the post may be square or triangular, as desired, the surface around the post is discontinuous. The discontinuous outer surface, which includes the vertically extending lateral edges of the flanges, provides attachment points for snap-on post covers, which, completely conceal the post, providing a desired pleasing appearance without the necessity of painting or otherwise finishing the extruded post. The snap-on post covers also complete the wire ways within the post, and provide quick and easy access to the wire ways for laying in or removing wires from the wire ways.

Predetermined portions of the flanges of the T-shaped members are removed, before or after the extruded post is cut to length, to provide access openings having flange defined lower edges for supporting upper and lower connector hook assemblies fixed to the vertically extending edges of the space dividing panels. The flanges are removed at upper and lower locations on the post, and if any particular post is long enough that a shorter standard panel height may be connected thereto, the flanges are removed at corresponding intermediate locations, with one location for each standard height panel which may be connected to the pole.

For example, poles may be cut to five different lengths for accommodating standard panel heights of 36, 52, 62, 68 and 84 inches. The pole for an 84 inch panel, for example, would have four intermediate support positions between the lowermost and uppermost positions for accommodating the four shorter panels. The pole for the 68 inch panel would have three intermediate support positions, etc. Thus, each post length is ready when manufactured to connect a panel having the panel height it was manufactured for to any lower standard height panel, without requiring any extra or special parts.

The upper and lower connector assemblies fixed to the vertical edges of the space dividing panels each have two horizontally spaced hooks which are spaced to snugly straddle the leg or stem of a T-shaped member, with the flange defined lower edge of the opening supporting the hooks and the associated panel.

BRIEF DESCRIPTION OF THE DRAWINGS

The invention will become more apparent by reading the following detailed description in conjunction with the drawings which are shown by way of example only, wherein:

FIG. 2 is a plan view of the post shown in FIG. 1;

FIG. 3 is a fragmentary, exploded perspective view illustrating how a leveling assembly shown in FIG. 1 is fixed to the post;

FIG. 15 is a plan view illustrating inner and outer post covers for a post used in a 90 degree panel intersection;

FIG. 16 is an end view of the inside corner post cover shown in FIG. 15, except in an unstressed configuration;

FIG. 16A is an end view of an alternative embodiment of the inside corner post cover shown in FIG. 15, with the inside post cover being shown in an unstressed configuration;

FIG. 17 is a plan view of an end post cover, for a post which supports only one panel; and FIG. 18 is a plan view of a post cover for the 120 degree two-panel post shown in FIG. 13.

DESCRIPTION OF PREFERRED EMBODIMENTS

Figure 1:
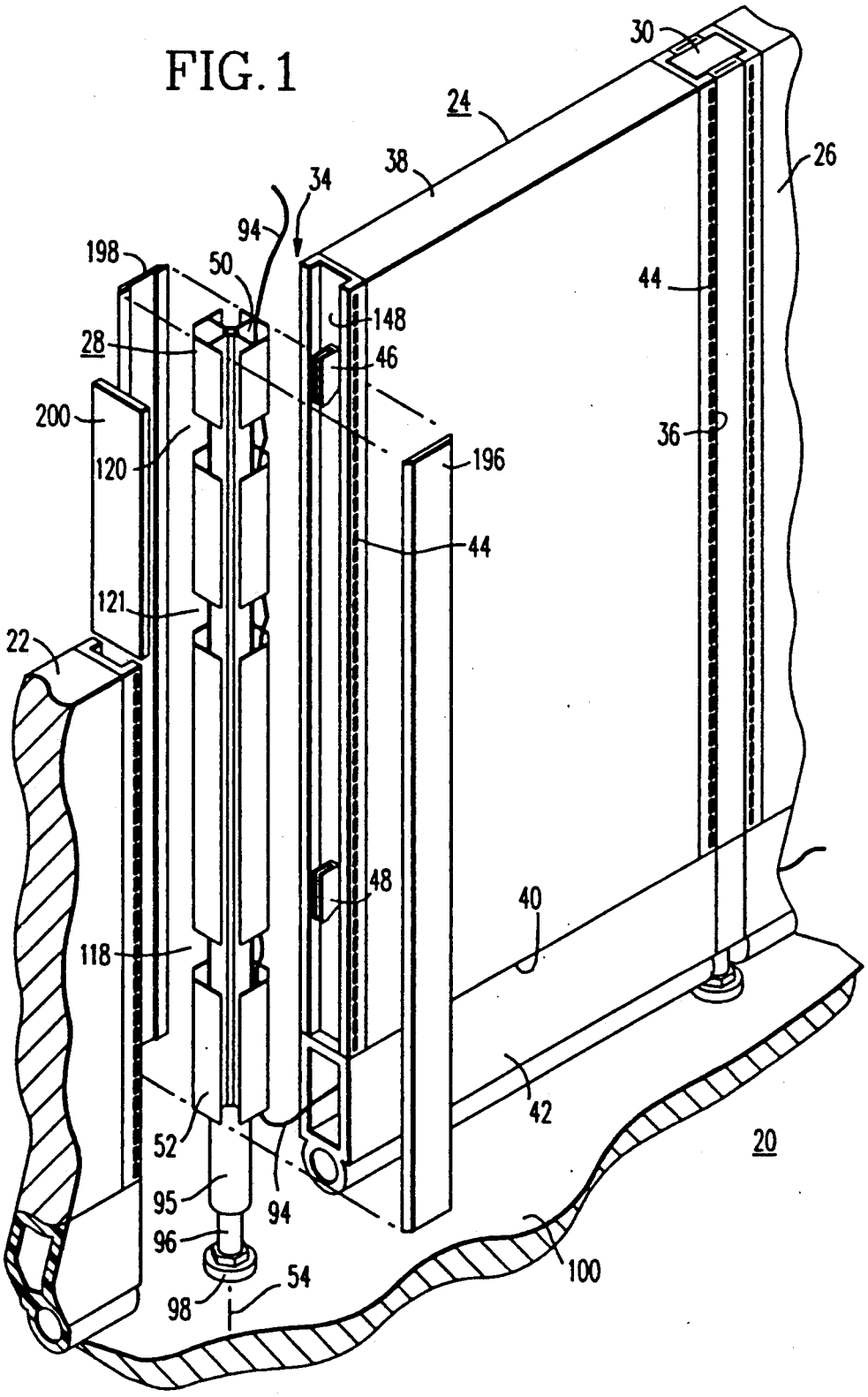
FIG. 1 is a partially exploded perspective view of a post-based office space dividing panel system constructed according to the teachings of the invention.

Referring now to the drawings, and to FIG. 1 in particular, there is shown a partially exploded perspective view of an office space dividing system 20 constructed according to the teachings of the invention. Space dividing system 20 includes a plurality of space dividing panels 22, 24 and 26 supported by posts 28 and 30. Each panel, such as panel 24, includes first and second vertical edges 34 and 36, a top 38 and a bottom 40, the lower edge of which may have a raceway 42 fixed thereto. Each vertical edge 34 and 36 has a slotted standard 44 fixed thereto for hanging work surfaces, cabinets, and the like. Each vertical edge 34 and 36 has upper and lower connector assemblies 46 and 48 fixed to the slotted standard 44, as will be hereinafter described in detail.

Each post 28 is extruded from a suitable metal, such as aluminum, and is thus an elongated structure having first and second ends 50 and 52, and a longitudinal axis 54 extending between the ends. Each post 28 has a longitudinally extending solid core 56, best shown in FIG. 2, which is a top or plan view of post 28. A tapped opening 58 is provided in the upper end of core 50, for receiving a top cap screw (not shown) for securing a panel rigidizer (not shown), as disclosed in U.S. Pat. No. 4,424,654, which patent is assigned to the same assignee as the present application.

Each post has a plurality of longitudinally extending, circumferentially spaced T-shaped members extending outwardly from the central core 56. As illustrated in FIGS. 1 and 2, post 28 has first, second, third and fourth symmetrically arranged T-shaped members 60, 62, 64 and 66. Each T-shaped member of post 28 is of like construction, such as T-shaped member 60 shown in FIG. 2, which has a stem, web or leg portion 68 and a flange portion 70. Leg portion 68 has first and second ends 72 and 74, and flange 70, which is flat, has first and second lateral edges 76 and 78, and inner and outer surfaces 80 and 82. The first end 72 of leg portion 68 is integrally attached to central core 56, and the second end 74 of leg portion 68 is integrally attached to the inner surface 80 of flange 70, intermediate the lateral edges 76 and 78, e.g., bisecting the width of flange 70. As shown in FIG. 2, the angle 84 between adjacent leg portions 68 of post 28 is 90 degrees, e.g., the T-shaped members are equally circumferentially spaced.

It will be noted from FIG. 2 that the leg portions 68 of the T-shaped members 60, 62, 64 and 66 space the flanges 70 outwardly from the central core 56, providing first, second third and fourth vertical wire ways 86, 88, 90 and 92, such as for a wire 94 shown in FIG. 1. To provide ample access space to the wire ways 86, 88, 90 and 92, the flanges 70 have a width dimension between their lateral edges 76 and 78 which provides a relatively wide spacing between the lateral edges of adjacent T-shaped members. For example, if the dimension of pole 28 between the outer surfaces of oppositely positioned flanges, such as the .dimension between the outer surfaces 82 of flanges 70 of the T-shaped members 60 and 64, is 1.5 inches, a typical width dimension of a flange 70 would be 0.75 inch, providing an access spacing between adjacent flanges of 0.5 inch, which is adequate for communication wiring. Thus, while the basic outer configuration of post 28 is square, the outer surface of post 28 is discontinuous, having four access openings to the wire ways 86, 88, 90 and 92 bounded by eight lateral edges of four flanges 70.

As hereinbefore stated, the upper end 50 of pole 28 has a tapped opening 58 for receiving a top cap screw. The lower end 52 of pole 28 has a leveler assembly which comprises a stationary hollow tubular member 95, an adjustable leveler rod 96, and a glide 98 which rests upon a floor 100 of an associated building.

Hollow tubular member 95, as best shown in FIG. 3, has first and second ends 102 and 104, and an opening 106 which extends between its ends. Opening 106 has a diameter selected to be a snug press fit with an element having the diameter of central core 56. Opening 106 is tapped, starting at the first end 102 of tubular member 95, as indicated at 108, for threadably receiving the adjustable leveler rod 95.

Figure 4:
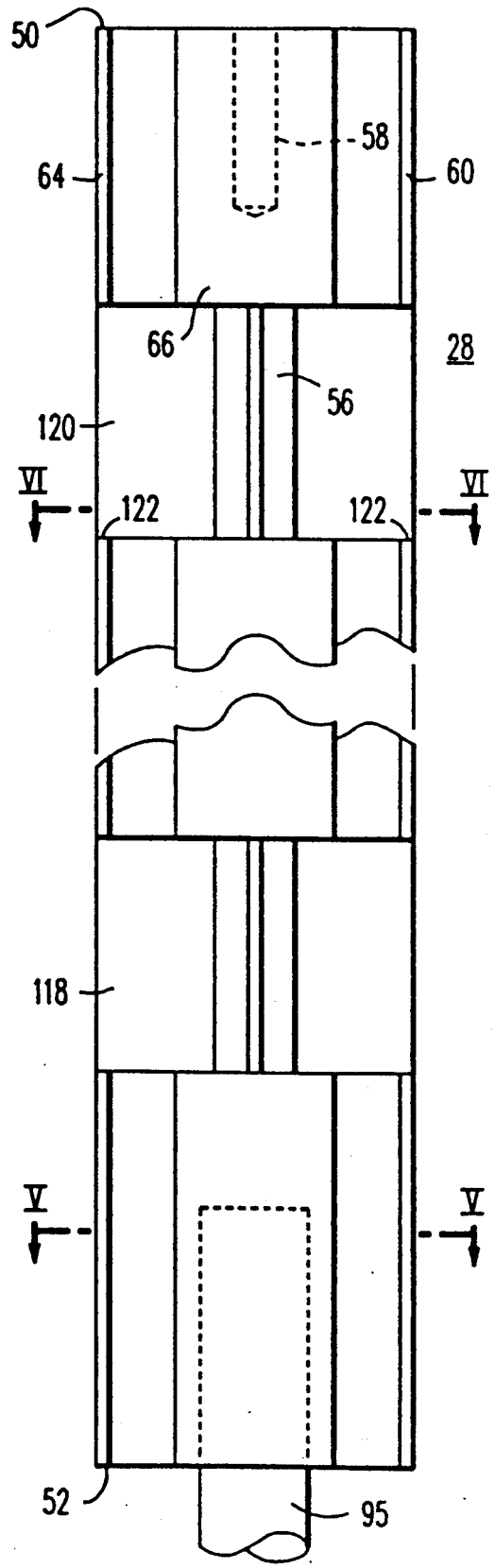
FIG. 4 is a fragmentary elevational view of the post shown in FIG. 1.
Figure 5:
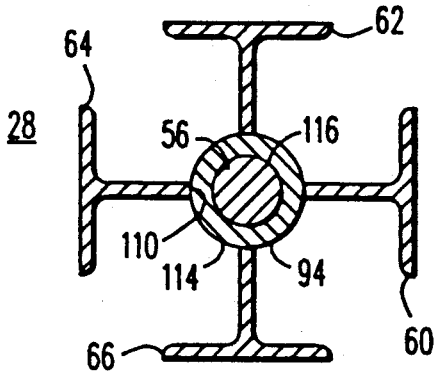
FIG. 5 is a cross sectional view of the post shown in FIG. 4, taken between and in the direction of arrows V—V in FIG. 4.

As best shown in FIG. 3, tubular member 95 is fixed to the bottom end 52 of post 28 by hollow milling the leg portions of all four T-shaped members 60, 62, 64 and 66, starting at the bottom end 52 of post 28, removing a portion of each leg 68 for a predetermined longitudinal dimension immediately adjacent to central core 56. The dimension between the central core 56 and the cut edges 110 is selected to be substantially the same as the wall thickness of tubular member 95, such that tubular member 95 may be pressed into the milled opening 112, with central core 56 entering opening 106 at the second end 104 of tubular member 95. Thus, the cut edges 110 tightly engage the outer surface 114 of tubular member 95, and the outer surface 116 of central core 56 tightly engages the inner wall of tubular member 95. FIG. 4 is an elevational view of post 28, with parts cut away, illustrating tubular member 95 in assembled position with pole 28. FIG. 5 is a cross sectional view through post 28 taken between and in the direction of arrows V—V in FIG. 4, illustrating the press fit between the tubular member 95 and post 28.

Figure 6:
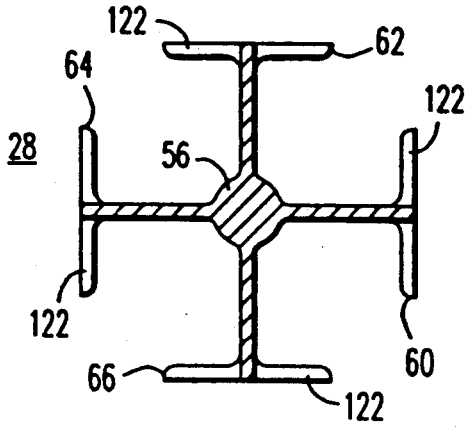
FIG. 6 is a cross sectional view of the post shown in FIG. 4, taken between and in the direction of arrows VI—VI in FIG. 4.

Pole 28 includes at least two panel support access openings, a lower access opening 118 and an upper access opening 120. Pole 28, depending upon its height, may include one or more panel support access openings for supporting one or more lower height panels, with one additional panel support access opening 121 being illustrated in FIG. 1. Each panel access opening is provided by removing a portion of each flange of the four T-shaped members 60, 62, 64 and 66 for a predetermined longitudinal dimension. For example, the flange portions may be die removed by inserting a tool on the underside of each flange and pulling outwardly, cleanly cutting the desired length of flange 70 from the leg portion 68. Each such access opening, such as upper access opening 120, thus has four flange-defined lower edges 122. FIG. 6 is a sectional view of post 28 taken between and in the direction of arrows VI—VI in FIG. 4, clearly illustrating the four flange defined lower edges 122 of panel support access opening 120.

Figure 7:
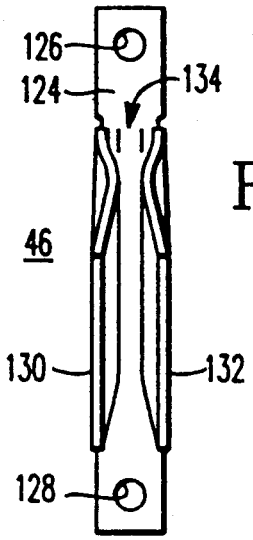
FIG. 7 is a front elevational view of a connector assembly shown in FIG. 1.
Figure 8:
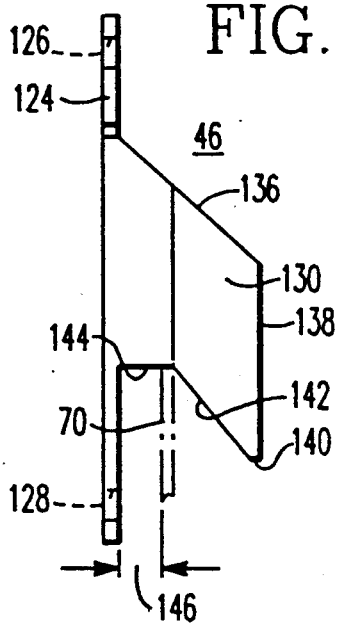
FIG. 8 is a side elevational view of the connector assembly shown in FIG. 7.

Each connector assembly 46 and 48 is of like construction, so only connector assembly 46 will be described in detail. FIGS. 7 and 8 are front and side elevational views, respectively, of connector assembly 46. Connector assembly 46 includes a support base 124 having upper and lower fastener openings 126 and 128. Base 124 is securely fixed to slotted standard 44 via suitable fasteners, such as screws. First and second hook members 130 and 132 extend integrally outward from support base 124, converging inwardly towards one another until a predetermined spacing 134 is reached, which spacing is substantially the same as the thickness dimension of a leg portion 68 of a T-shaped member. The hook members then flare outwardly away from one another to function as a "funnel" shaped guide as the connector assembly straddles a leg portion 68, as will be hereinafter described.

Each hook member, such as hook member 130 shown in FIG. 8, includes an upper portion 136 which angles downwardly away from base 124 with a predetermined obtuse angle, terminating at a front vertically oriented edge 138. Hook 130 then extends horizontally back towards base 124 via a short lower portion 140, and then hook 130 angles upwardly via a guide portion 142, which guides flange 70, shown in phantom in FIG. 8, to a seated position relative to a horizontal portion 144 which extends from guide portion 142 back to support base 124. The seated position of flange 70 is against portion 144, immediately adjacent the intersection of guide portion 142. The spacing between flange 70 and base 124, indicated at 146, is occupied by the slotted standard 44, and thus the proper seated position for flange 70 is the only location available at the end of guide portion 142, assuring exact positioning of connector assembly 46 relative to post 28.

Figure 9:
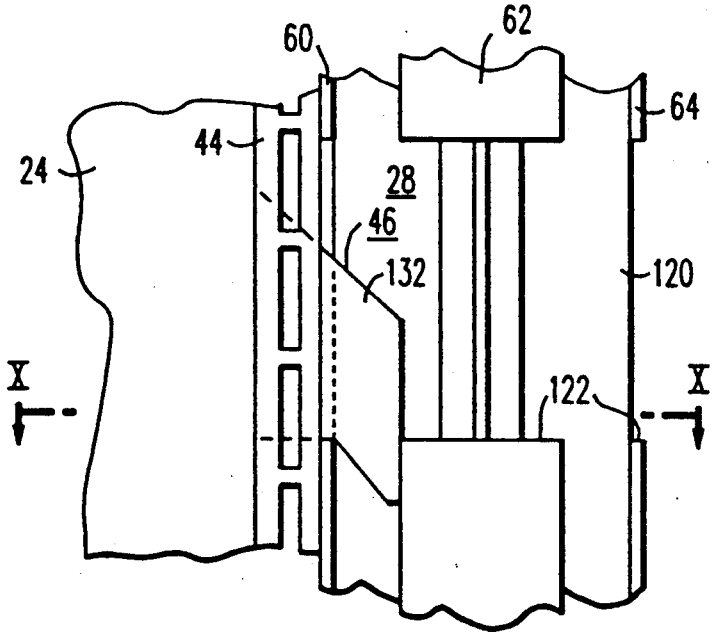
FIG. 9 is an enlarged fragmentary elevational view of the connector assembly shown in FIGS. 1, 7 and 8, supporting a panel on a post.
Figure 10:
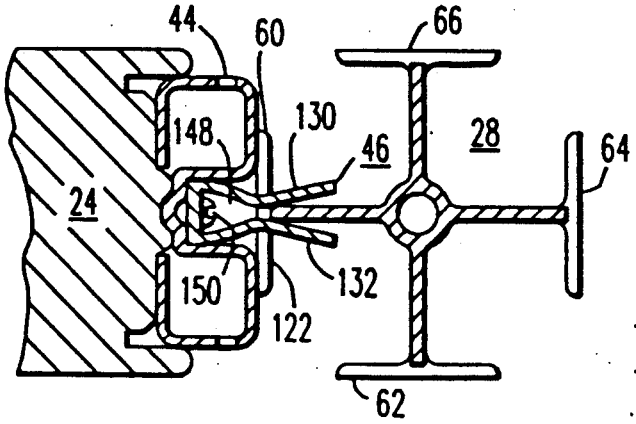
FIG. 10 is a cross sectional view illustrating the panel to post connection shown in FIG. 9, taken between and in the direction of arrows X—X in FIG. 9.

FIG. 9 is an enlarged fragmentary side elevational view of connector assembly 46 engaging post 28 via upper access opening 120. FIG. 10 is a cross sectional view taken between and in the direction of arrows X—X in FIG. 9, which clearly illustrates connector assembly 46 in its support position on post 28. As most clearly shown in FIGS. 1 and 10, the slotted standard 44 includes a U-shaped centrally located longitudinally extending channel 148 within which connector assembly 46 is secured by a pair of fasteners, such as screws 150.

When panel 24 is connected to post 28, the flared "funnel" of the inwardly converging downwardly depending hooks 130 and 132 of the upper and lower connector assemblies 46 and 48 guide the leg portion 68 of a T-shaped member between the hooks 130 and 132, and the angled guide surfaces 142 of hooks 130 and 132 guide the flange-defined support edges 122 into the seated position shown in FIGS. 8 and 9. When a panel rigidizer shown in the hereinbefore mentioned U.S. Pat. No. 4,424,654 is fixed to the top of post 28 and any adjoining panels a panel cannot be lifted out of the assembled position.

Post 28, with four flat sides can support one, two, three or four panels, as desired. Further, the post 28, as manufactured and delivered to an installation site can accommodate the height of a panel it was manufactured for, and if shorter standard panel heights are available than the height of panel the post was manufactured for, panel support openings will already be available for supporting such a panel.

If five post heights are available for five panel heights of 36, 52, 62, 68 and 84 inches, for example, then post 28, illustrated with one intermediate panel support access opening 121, would be a post manufactured for a 52 inch high panel. Thus, one, two, three or four 52 inch high panels may be supported by post 28. The lower height panel 22 shown in FIG. 1 would thus be a 36 inch high panel, in the example. If post 28 was for an 84 inch high panel, for example, then four intermediate panel support access openings would be provided for accommodating the four lower height panels available.

Post 28 may be used to support a single panel at the end of a run, two panels in a straight line, two panels at right angles to one another, three panels in a "T" configuration, and four panels in a cross configuration.

Figure 11:
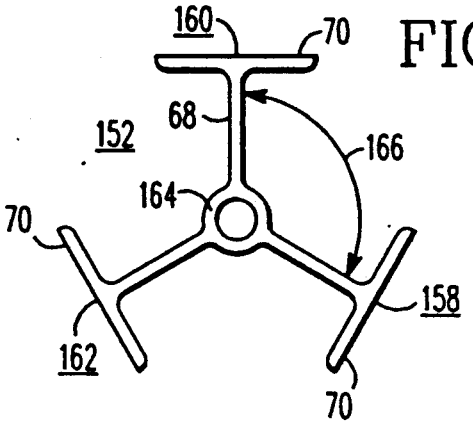
FIG. 11 is a plan view of a post for a symmetrical three-way panel intersection constructed according to embodiment of the invention.
Figure 12:
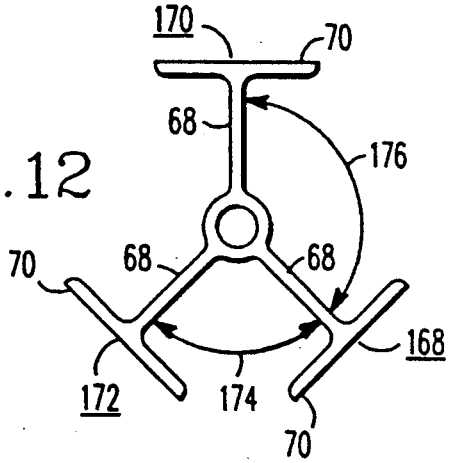
FIG. 12 is a plan view of a post for a non-symmetrical three-way panel intersection constructed according to another embodiment of the invention.
Figure 13:
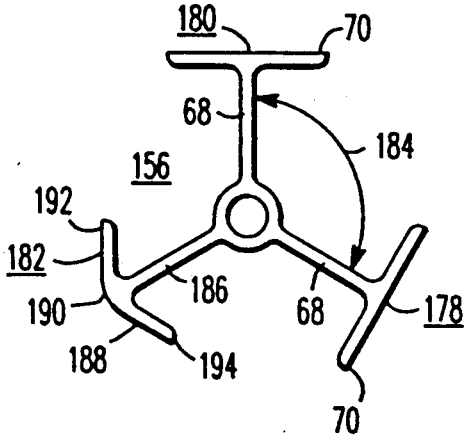
FIG. 13 is a plan view of a post for a 120 degree two-way panel intersection constructed according to still another embodiment of the invention.

Posts may be extruded to different configurations as illustrated in FIGS. 11, 12 and 13, which are top views of posts 152, 154 and 156 constructed according to other embodiments of the invention.

FIG. 11 illustrates a post 152 having three T-shaped members 158, 160 and 162 equally circumferentially spaced about a central core 164, i.e., by an angle 166 between T-shaped members of 120 degrees. Each T-shaped member 158, 160 and 162 has the same configuration as the hereinbefore described T-shaped member 60 of post 28, and they function the same as described relative to post 28. Post 152 is thus used to support panels in a three-way intersection wherein the panels are circumferentially spaced 120 degrees apart.

FIG. 12 illustrates a post 154 having three T-shaped members 168, 170 and 172, and is thus similar to post 152 shown in FIG. 11. The difference lies in the circumferential spacing. T-shaped members 168 and 172 are spaced by an angle 174 of ninety degrees, and T-shaped member 170 is spaced from each of the T-shaped members 168 and 172 by an angle 176 of 135 degrees. Thus, post 154 is used to support panels in a three-way intersection wherein two panels are spaced ninety degrees apart and the third panel is spaced 135 degrees from each of the first two panels.

FIG. 13 illustrates a post 156 having three T-shaped members 178, 180 and 182, equally circumferentially spaced by an angle 184 of 120 degrees, and thus post 156 is similar to post 154. Post 156, however, is for a two-way intersection, instead of a three-way intersection, with T-shaped member 182 not being configured to support a panel. T-shaped member 182 includes a leg 186 similar to leg 68 of T-shaped member 60, and a flange 188. Flange 188, instead of being flat, has a curved central portion 190 which joins straight leg portions 192 and 194. Leg portion 192 is oriented parallel with leg portion 68 of T-shaped member 180, and leg portion 194 is oriented parallel with leg portion 68 of T-shaped member 178.

Figure 14:
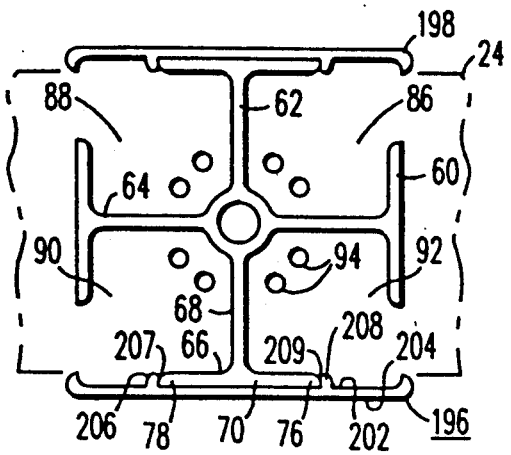
FIG. 14 is a plan view illustrating post covers for a post used in a 180 degree panel intersection.

The lateral edges of the flanges, in addition to defining the edges of access openings to the wire ways, provide convenient attachment points for post covers which complete the wire ways and conceal the post. FIG. 1 illustrates post covers 196, 198 and 200, which may be of similar construction. FIG. 14 is a plan view of post 28 with post covers 196 and 198 assembled with post 28. Post cover 196 may be extruded of polyvinylchloride (PVC), or other suitable plastic, and cut to the desired length. They may be extruded with the desired color, or covered with a fabric to match the fabric of the panels, as desired.

Post cover 196 has inner and outer surfaces 202 and 204, with the inner surface 202 having first and second spaced retaining beads 206 and 208. The retaining beads 206 and 208 have inwardly directed hook portions 207 and 209, respectively, with the beads 206 and 208 being spaced such that the width of a flange 70 between the lateral edges is just slightly greater than the dimension between the inwardly directed hook portions 207 and 209 of beads 206 and 208. Thus, post cover 196 may be quickly attached to a flange 70 by pressing the cover against the flange, resiliently bending the hook portions of the retaining beads outwardly until flange 70 passes the restraining hook portions, allowing the hook portions to return to their unstressed positions, firmly holding the post cover 196 in the desired position on post 28.

As illustrated in FIG. 14, a plurality of wires 94 may be disposed in any of the wire ways when post 28 is used in a 180 degree intersection between panels, with post covers 196 and 198 concealing and completing the wire ways as well as concealing the extruded metal of the post 28, making it unnecessary to finish the surface of the extruded metal. When access is desired to any of the wire ways for laying in, or removing wiring, the requisite post cover may be quickly removed and then replaced.

FIG. 15 illustrates a post cover 210 which may be used when post 28 is used in a 90 degree intersection between two panels. Post cover 210, which may be extruded of PVC, for example, has a right angle configuration which includes a curved central portion 212 which joins first and second leg portions 214 and 216. Post cover 210 has inner and outer surfaces 218 and 220, with the inner surface 218 having retaining beads 222 and 224 on leg portions 214 and 216, respectively. Thus, post cover 210 may be quickly snapped over lateral edges 78 and 76 of flanges 70 of T-shaped members 62 and 64, respectively, to cover the extruded portions of post 28 and complete the wire ways. Wiring 94 may be placed in any wire way except wire way 92, which is in the 90 degree angle between the panels 226 and 228 shown in phantom, and therefor not accessible via a post cover.

The gap in the 90 degree corner is concealed by a 90 degree inside corner post cover 230 which is shown in an assembled stressed configuration in FIG. 15, and in an unstressed configuration in FIG. 16. Inside corner post cover 230, which may be extruded of PVC, for example, includes a center portion 232 integrally joined to first and second leg portions 234 and 236 via reduced thickness portions 238 and 240, respectively, which function as "living hinges". To position inside corner post cover 230, the legs 234 and 236 are flexed towards one another via hinges 238 and 240, and they are inserted into the gap between the panels 226 and 228. Upon releasing the biasing pressure against the legs, the legs flex outwardly towards the unstressed configuration shown in FIG. 16, until they contact the inner surfaces 80 of flanges 70 of T-shaped members 60 and 66. The inner surfaces 80 maintain the desired assembled position of inside corner cover 230. Inside corner post cover 230 may be removed by pinching the legs 234 and 236 towards one another and pulling the inner corner post cover 230 outwardly.

FIG. 16A is an end view of a 90 degree inside corner post cover 231 constructed according to an embodiment of the invention which does not use living hinges. Post cover 231 is shown in an unstressed configuration in FIG. 16A. Post cover 231, which may be extruded PVC, for example, includes a substantially U-shaped center portion having a bight 233 and first and second leg portions 235 and 237, respectively. The first and second leg portions 235 and 237 include slightly curved lower portions 239 and 241 respectively, which extend outwardly from bight 233, approximately perpendicular thereto, with the curved portions 239 and 241 entering substantially straight portions 243 and 245 which have an outward flare, relative to the bight 233, of approximately 45 degrees. Legs 235 and 237 are very flexible, and to place inner corner post cover 231 in its operative position, legs 235 and 237 are flexed towards one another and inserted into the gap between panels 226 and 228. Upon releasing the bias, the legs flex outwardly towards the unstressed configuration illustrated in FIG. 16A. The stressed configuration of post cover 231 is very close to the unstressed configuration, with only the hereinbefore mentioned 45 degree angle of the legs relative to the bight 233 being slightly greater.

FIG. 17 is a plan view of an end post cover 242, used when post 28 supports a single panel 244 at the end of a wall or run. End post cover 242, which may be extruded of PVC, for example, is substantially U-shaped in cross section, having a bight 246 and first and second by portions 248 and 250. End post cover has inner and outer surfaces 252 and 254, respectively, with inner surface 254 having retaining beads 256 and 258 integrally formed therewith. Beads 256 and 258 engage lateral edges 78 and 76 of flanges 70 of T-shaped members 62 and 66, to retain cover 242 in the desired assembled relation with post 28. Wiring 94 may be disposed in any of the four wire ways.

FIG. 18 is a plan view of post 156 shown in FIG. 13, having a 120 degree outside post cover 260, which may be extruded of PVC, for example. Post cover 260 includes a curved center portion 262 which joins first and second straight leg portions 264 and 266 Post cover 260 has outer and inner surfaces 268 and 270, respectively, with inner surface having retaining beads 272 and 274 on leg portions 264 and 266, respectively. Retaining beads 272 and 274 engage lateral edges 276 and 278, respectively, of flange 188, enabling wire ways 280 and 282 to be used for wiring 94.

What is claimed is:

1. A space dividing system comprising:

a vertically disposed post having upper and lower longitudinal ends and a plurality of sides, at least certain of which are flat, a space dividing panel having first and second vertical edges, upper and lower connector assemblies fixed to a vertical edge of said panel, said post having a longitudinally extending central core which is continuous between said upper and lower ends, and a plurality of longitudinally extending, circumferentially spaced leg members extending outwardly from said central core, with each leg member being substantially co-extensive with said central core, each of said leg members having first and second radial ends, the first radial end of each leg member being integrally attached to said central core, at least one flange member fixed to the second radial end of each of said plurality of leg members to define a substantially T-shaped cross-sectional configuration, with at least one of said leg members having a plurality of vertically spaced flange members, said flange members having first and second lateral edges and inner and outer surfaces, with said outer surfaces defining sides of said post, the second radial ends of said leg members being integrally attached to the inner surfaces of the associated flange members, intermediate the first and second lateral edges, the plurality of spaced flange members associated with said at least one leg member defining upper and lower access openings each having a flange-defined lower edge, said central core, leg members, and inner surfaces of the flange member defining vertical wire ways through the post, with the flange members being dimensioned between their lateral edges to provide access spaces to the wire ways between the lateral edges of flange members associated with adjacent leg members, each of said upper and lower connector assemblies including hook means, said upper and lower connector assemblies respectively entering said upper and lower access openings, with the hook means of said upper and lower connector assemblies being respectively supported by the flange-defined lower edges of the upper and lower access openings.

2. The space dividing system of claim 1 wherein the hook means of each of the upper and lower connector assemblies includes first and second horizontally spaced hook members, with the first and second horizontally spaced hook members being disposed on opposite sides of a leg member, with each leg member having a predetermined thickness dimension, and wherein the spacing between the first and second hook members is selected to accommodate said predetermined thickness dimension of a leg member with a snug slidable fit.

3. The space dividing system of claim 1 wherein the first radial end of each leg member terminates a predetermined dimension from the lower end of the post while the second radial end continues to substantially the lower end of the post, to provide an opening surrounding the central core, a tubular member having first and second ends, and an opening extending between said ends which is tapped for a predetermined dimension starting at the first end, the second end of said tubular member being disposed in the opening surrounding the central core, and with the central core entering the opening at the second end of said tubular member, with predetermined dimensions of the tubular member and post being selected to provide a press fit between the tubular member and the post, and a leveler assembly having an upper end threadably engaged with the tapped opening at the first end of the tubular member.

4. The space dividing system of claim 1 wherein the post includes first, second, third and fourth equally spaced leg members, with each leg member having a plurality of spaced flange members which define access openings at predetermined spaced upper and lower locations, each of said access openings having a flange-defined lower edge suitable for supporting a space dividing panel.

5. The space dividing system of claim 1 wherein the post includes first, second and third equally spaced leg members, with each of the leg members having a plurality of spaced flange members which define access openings at predetermined spaced upper and lower locations, each of said access openings having a flange-defined lower edge suitable for supporting a space dividing panel.

6. The space dividing system of claim 1 wherein the post includes first, second and third equally spaced leg members, with the first and second leg members having a plurality of spaced flange members which define access openings at predetermined upper and lower locations, each of said access openings having a flange-defined lower edge suitable for supporting a space dividing panel.

7. The space dividing system of claim 6 wherein the flange members associated with the first and second leg members are flat, and the flange member associated with the third leg member is curved.

8. The space dividing system of claim 1 wherein the post includes first, second, and third leg members, with the first and second leg members being spaced 90 degrees apart, and with the third leg member being spaced 135 degrees from each of the first and second leg members, with each having a plurality of spaced flange members which define access openings at predetermined upper and lower locations, each of said access openings having a flange defined lower edge suitable for supporting a space dividing panel.

9. The space dividing system of claim 1 wherein the post includes first, second, third and fourth equally spaced leg members, with the first and third leg members being directly opposite one another, and wherein the space dividing panel is supported by edges of flange members associated with the first leg member, and including a U-shaped post cover having a bight and first and second leg portions having inner and outer surfaces, and including a retaining bead on the inner surface of each of the first and second leg portions which respectively removably engage a lateral edge of flange members associated with the second and fourth leg members.

10. The space dividing system of claim 1 wherein the post includes first, second, third and fourth equally spaced leg members, with the first and third leg members being directly opposite one another, and wherein the space dividing panel is supported by edges of flange members associated with the first leg member, a space dividing panel supported by edges of flange members associated with the third leg member, and a substantially flat post cover having inner and outer surfaces, and first and second spaced retaining beads on the inner surface which removably engage lateral edges of a flange member associated with the second leg member.

11. The space dividing system of claim 1 wherein the post includes first, second, third and fourth equally spaced leg members, with the first and third leg members being directly opposite one another, and wherein the space dividing panel is supported by edges of flange members associated with the first leg member, a space dividing panel supported by the fourth leg member, and a substantially L-shaped post cover having first and second right angle leg portions and inner and outer surfaces, and including retaining beads on the inner surfaces of the right angle leg portions which removably engage lateral edges of flange members associated with the second and third leg members.

12. The space dividing system of claim 11 including an inside corner post cover between flange members associated with the first and fourth leg members, said inside corner post cover having first and second leg portions joined by an integral resiliently bendable portion which tends to return the inside corner post cover to an unstressed, substantially flat configuration when the first and second legs are bent towards one another, with inner surfaces of flange members associated with the first and fourth leg members holding the first and second leg portions of the inside corner post cover in a stressed configuration.

13. The space dividing system of claim 11 including an inside corner post cover between flange members associated with the first and fourth leg members, said inside corner post cover having a substantially U-shaped cross sectional configuration when stressed and unstressed, including a bight and first and second leg portions, with the first and second leg portions each having a curved portion joined to the bight which extends substantially perpendicularly outward from the bight, with the curved portion joining a substantially straight portion which makes an angle of about 45 degrees with the bight when the inside corner post cover is unstressed, and only a slightly greater angle when in an operatively stressed configuration in which inner surfaces of flange members associated with the first and fourth leg members hold the first and second leg portions of said inside corner post cover in the stressed configuration.

14. The space dividing system of claim 1 wherein the post includes first, second, third and fourth equally spaced leg members, with the first and third leg members being directly opposite one another, and wherein the space dividing panel is supported by edges of flange members associated with the first leg member, a space dividing panel supported by edges of flange members associated with the fourth leg member, and including an inside corner post cover having first and second leg portions joined by an integral resiliently bendable portion which tends to return the inside corner post cover to an unstressed, substantially flat configuration when the first and second legs are bent towards one another, with inner surfaces of flange members associated with the first and fourth leg members holding the first and second leg portions of said inside corner post cover in a stressed configuration.

15. The space dividing system of claim 1 wherein the post includes first, second and third equally spaced leg members, with edges of flange members associated with the first leg member supporting the space dividing panel, and including a space dividing panel supported by flange members associated with the second leg member, and including a post cover having inner and outer surfaces, and including first and second retaining beads on the inner surface which removably engage lateral edges of flange members associated with the third leg member.

16. The space dividing system of claim 15 wherein the flange members associated with the first and second leg members are flat, and the flange member associated with the third leg member is curved, with the post cover having first and second leg portions joined by a predetermined obtuse angle, with the first and second retaining beads being on the first and second leg portions, respectively.

17. The space dividing system of claim 1 including removable post cover means disposed to cover each side of the post not associated with a space dividing panel, to cover the access spaces to the wire ways.

18. The space dividing system of claim 1 wherein a second of the plurality of leg members has a plurality of spaced flange members which define upper and lower access openings each having a flange-defined lower edge, and a second space dividing panel having upper and lower connector assemblies supported by the flange-defined lower edges of the upper and lower access openings associated with the second leg member.

19. The space dividing system of claim 18 wherein the second space dividing panel has the same height dimension as the at least one panel, and the upper and lower access openings associated with the second leg member are at the same respective elevations as the upper and lower access openings associated with the at least one leg member.

20. The space dividing system of claim 18 wherein the second space dividing panel has a lesser height dimension than the at least one panel, the lower access opening associated with the at least one leg member is at substantially the same elevation as the lower access opening associated with the second leg member, and the upper access opening associated with the second leg member is at a lower elevation than the upper access opening associated with the at least one leg member.

* * * * *